US007635128B2

(12) United States Patent
Sarada

(10) Patent No.: US 7,635,128 B2
(45) Date of Patent: Dec. 22, 2009

(54) SHEET POSITIONING APPARATUS IN A SHEET FEEDING SECTION OF A PRINTING PRESS

(75) Inventor: Hiroyuki Sarada, Fuchu (JP)

(73) Assignee: RYOBI Ltd., Hiroshima-ken (JP)

( * ) Notice: Subject to any disclaimer, the term of this patent is extended or adjusted under 35 U.S.C. 154(b) by 186 days.

(21) Appl. No.: 11/016,456

(22) Filed: Dec. 16, 2004

(65) Prior Publication Data

US 2005/0133989 A1 Jun. 23, 2005

(30) Foreign Application Priority Data

Dec. 17, 2003 (JP) ..... 2003-419486

(51) Int. Cl.
*B65H 9/16* (2006.01)

(52) U.S. Cl. ..... 271/252; 271/250

(58) Field of Classification Search ..... 271/250, 271/252

See application file for complete search history.

(56) References Cited

U.S. PATENT DOCUMENTS

| | | | | | |
|---|---|---|---|---|---|
| 1,986,253 | A | * | 1/1935 | Cross | 271/252 |
| 2,712,936 | A | * | 7/1955 | Backhouse | 271/252 |
| 3,178,176 | A | * | 4/1965 | Peyrebrune | 271/252 |
| 3,754,755 | A | * | 8/1973 | Krochert | 271/236 |
| 4,896,875 | A | * | 1/1990 | Gotschewski | 271/236 |
| 5,014,977 | A | * | 5/1991 | Moore et al. | 271/221 |
| 5,120,047 | A | * | 6/1992 | Mandel et al. | 271/220 |
| 5,142,016 | A | * | 8/1992 | Sharf et al. | 528/60 |

(Continued)

FOREIGN PATENT DOCUMENTS

DE 689417 1/1950

(Continued)

OTHER PUBLICATIONS

Notification of Reasons for Refusal Issued from the Japan Patent Office on Sep. 11, 2009 for Japanese Patent Application No. 2003-419486.

(Continued)

*Primary Examiner*—Patrick H Mackey
*Assistant Examiner*—Michael C McCullough
(74) *Attorney, Agent, or Firm*—TIPS Group

(57) ABSTRACT

A sheet-holding-down member provided in a sheet feeding section of a printing press has a sheet-holding-down member that has a sheet-holding-down part that holds down from above an oncoming sheet to prevent a lateral edge of the sheet from being curled upward when the sheet abuts a lateral-edge abutment member. The sheet-holding-down member is pivotally movable about a roller support shaft so as to allow the sheet-holding-down part to be movable close to and away from an upper surface of a feeder board, on which the sheet is placed. An adjustment screw has a lower end that limits movement of the sheet-holding-down member so as to prevent the same from moving close to the upper surface of the feeder board as passing a predetermined height limit. The sheet-holding down member is urged downward by a coil spring. In a case where a sheet having a thickness larger than a predetermined thickness is used, the sheet-holding-down member is pivotally moved upward against the urging force of the coil spring, thereby allowing the sheet-holding-down part to move upward away from the upper surface of the feeder board.

4 Claims, 4 Drawing Sheets

U.S. PATENT DOCUMENTS

| | | | | | |
|---|---|---|---|---|---|
| 5,310,175 | A | * | 5/1994 | Riss et al. | 271/250 |
| 5,975,524 | A | * | 11/1999 | Dopke et al. | 271/245 |
| 6,142,466 | A | * | 11/2000 | Dickhoff | 271/220 |
| 6,866,261 | B2 | * | 3/2005 | Grasmuck et al. | 271/228 |

FOREIGN PATENT DOCUMENTS

| | | | | |
|---|---|---|---|---|
| DE | 4435264 | | | 4/1996 |
| DE | 29607343 | U | | 7/1996 |
| GB | 2312422 | | | 10/1997 |
| JP | 55087594 | A | * | 7/1980 |
| JP | 56150552 | A | | 11/1981 |
| JP | 02-041937 | | | 9/1988 |
| JP | 04226333 | A | * | 8/1992 |
| JP | 8108948 | | | 4/1996 |
| JP | 9002706 | A | | 1/1997 |
| JP | 10-250882 | | | 9/1998 |

OTHER PUBLICATIONS

Publication of Unexamined Utility Model Application for Japanese Utility Model Application No. Sho-63-144861, Filing Date Nov. 8, 1988, Mitsubishi Heavy Industries, Ltd.

* cited by examiner

SHEET POSITIONING APPARATUS IN A SHEET FEEDING SECTION OF A PRINTING PRESS

CROSS REFERENCE TO RELATED APPLICATION

This application claims priority from Japanese Patent Application No. 2003-419486, which is incorporated herein by reference.

BACKGROUND OF THE INVENTION

1. Field of the Invention

The present invention relates to a sheet positioning apparatus in a sheet feeding section of a printing press for lateral positioning of sheets of paper.

2. Related Art

In a conventional sheet feeding section, sheets of paper (hereinafter simply referred to sheets) are fed from the top of a stack one by one to a printing section. Specifically, sheets are fed from the stack onto a feeder board (a sheet mounting board) and then conveyed, and prior to being fed to the printing section, the leading edge of each sheet abuts a leading-edge abutment member for fore-aft positioning with respect to the sheet feeding direction, and then sheets are clamped by a pair of upper and lower rollers and then laterally displaced so as to make a lateral edge of each sheet abut a lateral-edge abutment member for lateral positioning. As used throughout the description, the directional term "fore-aft" and "laterally" or "lateral" are used with respect to the sheet feeding direction, in which sheets are fed from a sheet feeding section to a printing section in a printing press, as long as any specific definition is not made.

Sheets to be printed by the printing press have different thicknesses. For a relatively thick sheet, it is possible to securely make a lateral edge of the sheet abut the lateral-edge abutment member. On the contrary, a relatively thin sheet, which is likely to be with poor stiffness, may be forced upward or curled upward at its lateral edge, which results in poor accuracy in lateral positioning. In order to prevent this upward curling of a lateral edge of a relatively thin sheet, a sheet-holding-down member is disposed above the feeder board with a given distance therefrom so as to hold down the sheet from above, which sheet happens to be curled upward at a lateral edge due to abutment with the lateral-edge abutment member. Since a space between the sheet-holding-down member and a sheet on the feeder board is preferably set small enough to achieve efficient holding down of sheets, the sheet-holding-down member as provided is generally designed to be capable of adjusting the height thereof so that where a relatively thin sheet is used, the sheet-holding-down member is moved downward, and where a relatively thick sheet is used, it is moved upward. This type of mechanism is disclosed such as in Japanese Utility Model Application Laid-open No. Hei-2-41937 and Japanese Patent Application Laid-open No. Hei-10-250882.

The above sheet-holding-down member however requires the operator to adjust the height every time sheets are changed to those having a different thickness. This is a troublesome work and also may cause a trouble with sheet feeding when a thick sheet is fed with the sheet-holding-down member held at a lower position.

In consideration of the above problem, it is an object of the present invention to provide a sheet positioning apparatus equipped with a sheet-holding-down member that is capable of preventing upward curling of a lateral edge of a sheet, while reducing the workload of the operator in adjusting the height of the sheet-holding-down member according to the change in thickness of sheet.

SUMMARY OF THE INVENTION

According to one aspect of the present invention, there is provided a sheet positioning apparatus in a sheet feeding section for lateral positioning of sheets, each placed on a feeder board and fed in a sheet feeding direction to a printing section of a printing press. The sheet positioning apparatus includes: a laterally displacing means of displacing an oncoming sheet laterally with respect to the sheet feeding direction; a lateral-edge abutment member disposed to abut a lateral edge of the sheet so as to achieve lateral positioning; a sheet-holding-down member that has a sheet-holding-down part that holds down the sheet from above for preventing the lateral edge of the sheet from being curled upward when the sheet abuts the lateral-edge abutment member; said sheet-holding-down part of the sheet-holding-down member being movable close to and away from an upper surface of the feeder board; a limiter for limiting movement of the sheet-holding-down part so as to prevent the same from moving close to the upper surface of the feeder board as passing a predetermined height limit; and an urging means for urging the sheet-holding-down part to the upper surface of the feeder board, in which said sheet-holding-down part is moved upward away from the upper surface of the feeder board against the urging force of the urging means by the sheet displaced by the laterally displacing means, when the sheet has a thickness larger than a predetermined thickness.

In the sheet positioning apparatus having the above arrangement, although the sheet-holding-down member is designed to allow its sheet-holding-down part to be movable close to and away from the upper surface of the feeder board, the sheet-holding-down member does not move to a height lower than the predetermined height limit, since the limiter limits the movement of the sheet-holding-down member. This predetermined height limit is preferably set to be suitable for holding down from above a relatively thin sheet or a sheet having a thickness smaller than a predetermined thickness to prevent the upward curling of the relatively thin sheet. Thus, the sheet-holding-down member can prevent a lateral edge of a relatively thin sheet from being curled upward. On the other hand, although the sheet-holding-down member is kept urged downward by the urging means, it can move upward away from the predetermined height limit. Accordingly, when an attempt is made to move laterally a relatively thick sheet or a sheet having a thickness larger than a predetermined thickness to make its lateral edge abut the lateral-edge abutment member by the laterally displacing means with the sheet-holding-down part of the sheet-holding-down member set at a predetermined height, the sheet-holding-down part is pressed by this relatively thick sheet and necessarily forced upward or retracted upward against the urging force of the urging means. Therefore, it is possible to achieve lateral positioning even for a relatively thick sheet by making a lateral edge of the sheet abut the lateral-edge abutment member. As a result, it is possible to securely feed each sheet into the printing section.

In the present invention, the limiter may be arranged so as not to be adjustable in height. That is, it is possible to employ an arrangement where the limiter is of a fixed-type and the height limit which is predetermined for the sheet-holding-down member is not varied. However, the arrangement with the limiter adjustable in height, which allows the predetermined height limit to be varied, enables the apparatus to deal with great variation in thickness, as well as achieving fine adjustment to the predetermined height limit according to the type, stiffness or the like of sheets which may be varied even if they have a common thickness. Thus, more accurate positioning can be achieved.

While the sheet-holding-down member may be linearly moved upward and downward, it is also possible to make the sheet-holding-down member pivotally movable about an axis extending parallel to the sheet feeding direction. In this case, the sheet-holding-down member is retracted upward as it pivotally moves upon receiving pressure from a sheet, and therefore can be more smoothly retracted upward.

As described above, for a relatively thin sheet or a sheet having a thickness smaller than a predetermined thickness, it is possible to securely prevent upward curling of the sheet by the sheet-holding-down member. For a relatively thick sheet or a sheet having a thickness larger than a predetermined thickness, the sheet-holding part is necessarily forced upward upon receiving pressure from the sheet when it is laterally displaced. Thus, even with the height of the sheet-holding-down part set at a given height, it is possible to securely feed sheets having different thicknesses to the printing section as performing lateral positioning thereof. As a result, it is possible to omit the necessity to adjust the height of the sheet-holding-down member every time the thickness of a sheet is changed, and reduce the operator's workload.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Now, the description will be made for a sheet positioning apparatus in a sheet feeding section of a printing press, according to an embodiment of the present invention with reference to the drawings attached hereto.

Figure 1:
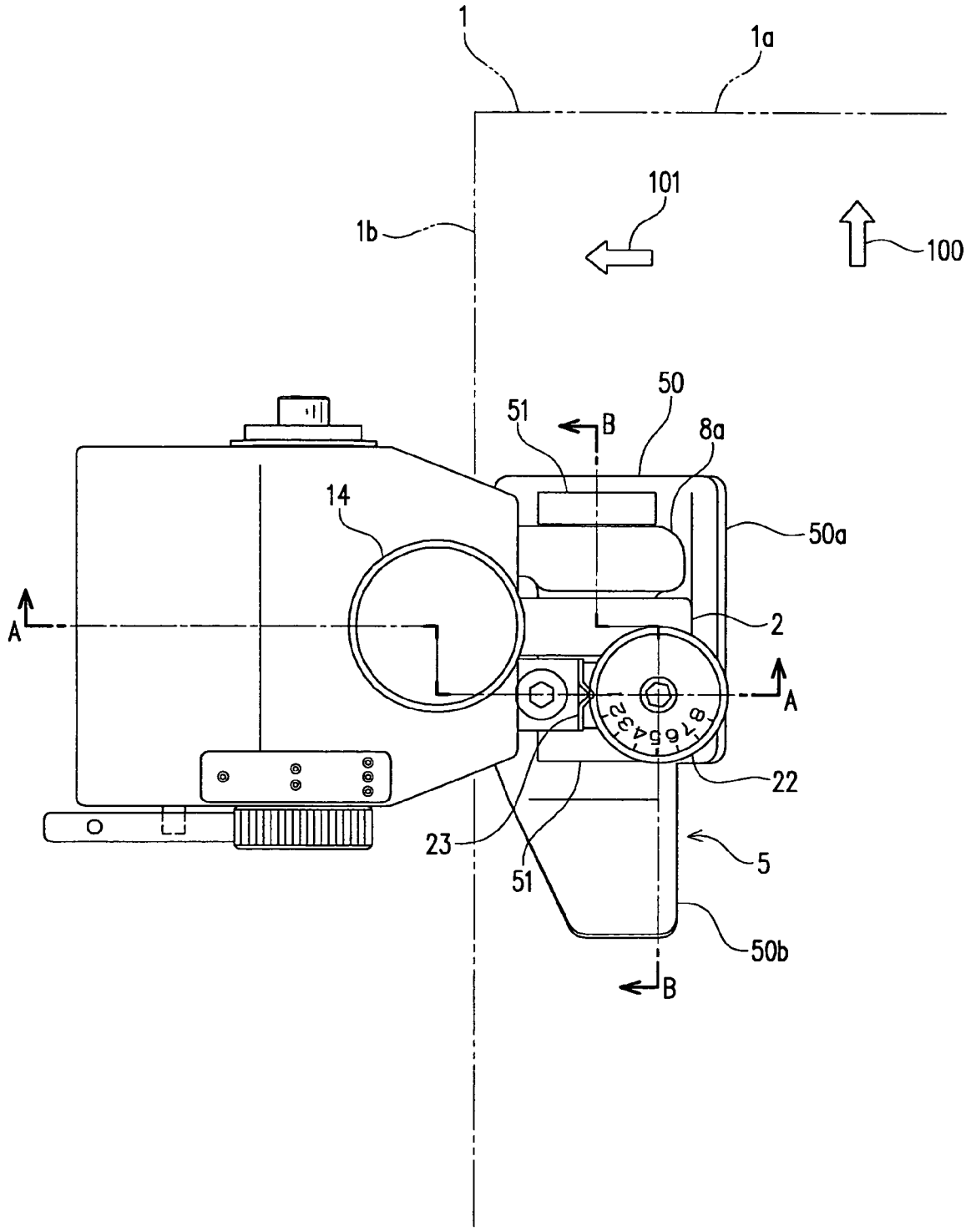
FIG. 1 is a plan view of a sheet positioning apparatus according to one embodiment of the present invention.

As illustrated in FIG. 1, a sheet 1 is first placed on a feeder board and conveyed in a direction represented by an arrow 100 (the sheet feeding direction) towards a printing section so as to make a leading edge thereof abut a leading-edge abutment member for fore-aft positioning or positioning with respect to the sheet feeding direction. The sheet 1 which has been thus positioned in the fore and aft direction is engaged with the sheet positioning apparatus of this embodiment, which moves the sheet 1 laterally or in the direction represented by an arrow 101 orthogonal to the sheet feeding direction to a side close to a lateral edge 1*b* of the sheet 1 for lateral positioning of the sheet 1.

Figure 2:
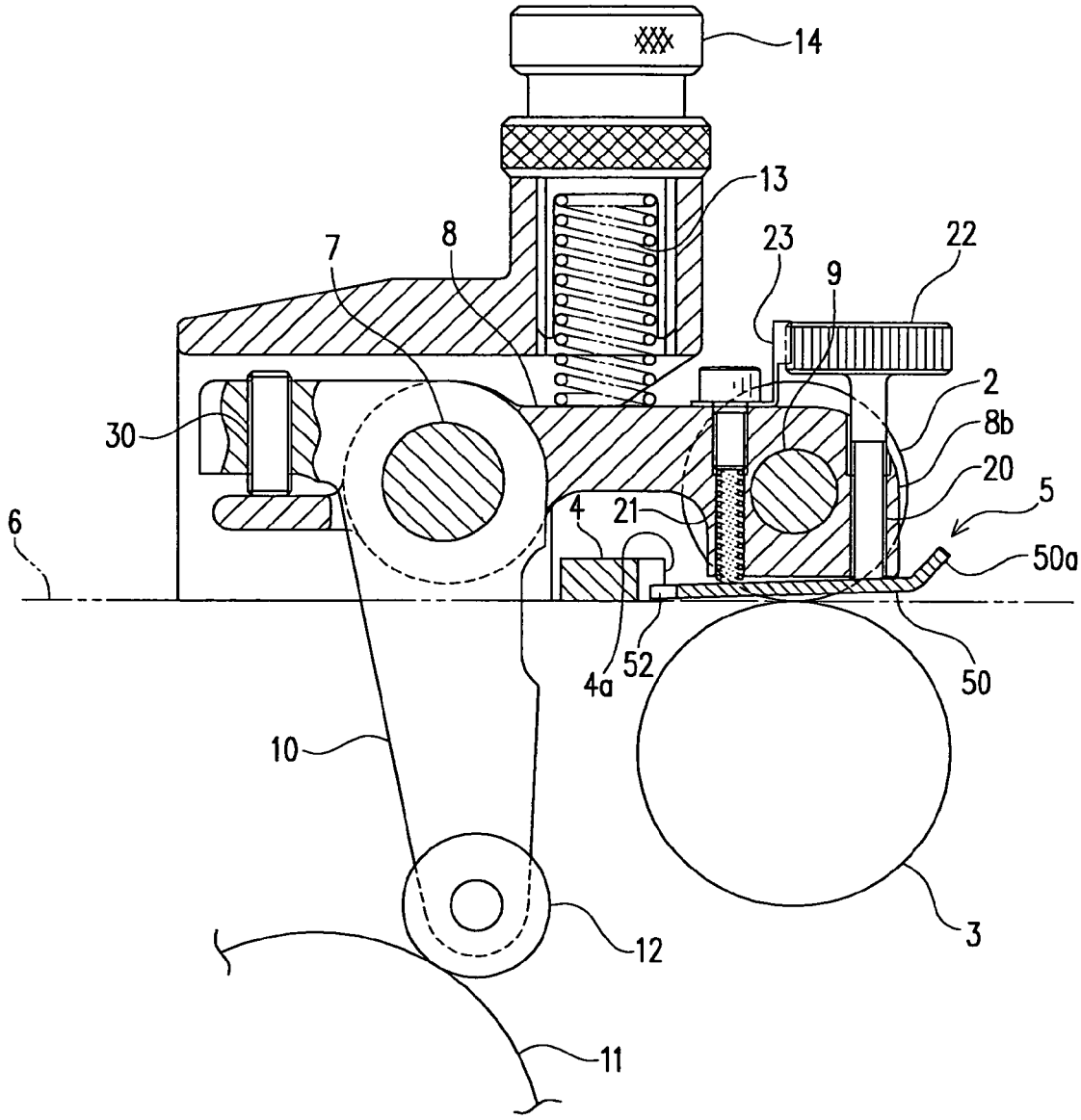
FIG. 2 is a cross sectional view taken along a line A-A in FIG. 1.
Figure 3:
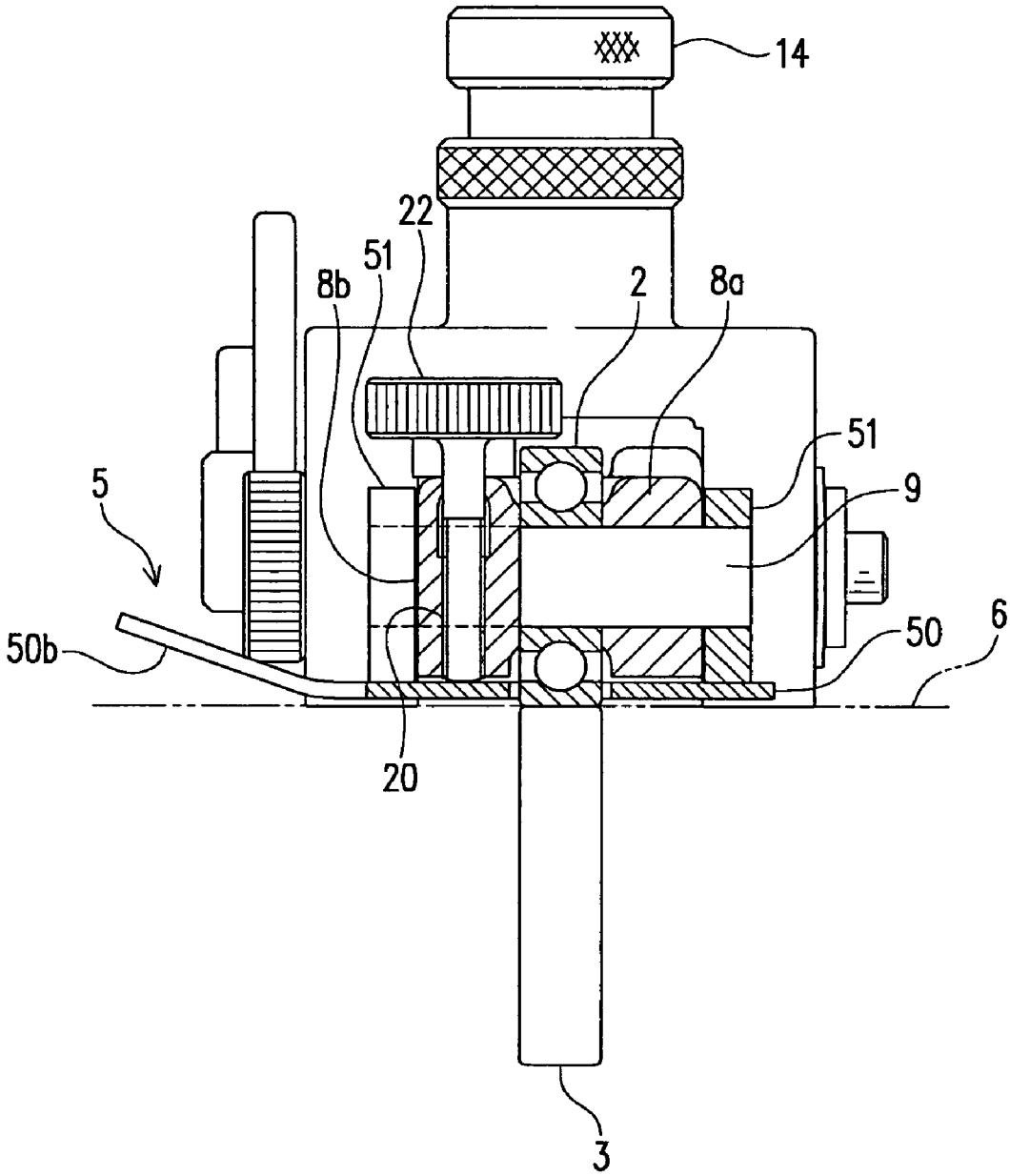
FIG. 3 is a cross sectional view taken along a line B-B in FIG. 1.

Specifically, as illustrated in FIGS. 2 and 3, the apparatus includes a pair of upper and lower rollers 2, 3 (a laterally displacing means) that rotate with the sheet 1 clamped therebetween, a lateral-edge abutment member 4 that abuts the lateral edge 1*b* of the sheet 1 which has been displaced by the pair of upper and lower rollers 2, 3 so as to achieve lateral positioning of the sheet 1, and a sheet-holding-down member 5 that holds down the sheet 1 from above so as to prevent the lateral edge 1*b* from being curled upward due to abutment with the lateral-edge abutment member 4.

The pair of upper and lower rollers 2, 3 each are rotated about the axis extending parallel to the fore and aft direction (the sheet feeding direction). Specifically, the lower roller 3 located beneath the sheet 1 is a driving roller, while the upper roller 2 located above the sheet 1 is a follower roller that follows the lower roller 3 upon receiving the driving force thereof. The contact point between the upper roller 2 and the lower roller 3 is equal in height to an upper surface 6 of the feeder board. The pair of these rollers 2, 3 are located closer to the lateral edge 1*b* than to the center, of the sheet 1 so as to pull and displace the sheet 1 into abutment against the lateral-edge abutment member 4. The lower roller 3 is fixed in position, while the upper roller 2 is vertically reciprocated according to the sheet feeding timing. Specifically, the sheet positioning apparatus has an arm support shaft 7 that is disposed on the left side of the feeder board as viewed in FIG. 1 or as viewed from the upstream side of the sheet feeding direction and that extends parallel to the sheet feeding direction. The arm support shaft 7 pivotally supports a first pivotally moving arm 8 that extends substantially horizontally towards the edge opposite to the lateral edge 1*b*, of the sheet 1, and that is bifurcated at a distal end into a pair of extensions 8*a*, 8*b* along the sheet feeding direction. These extensions 8*a*, 8*b* together support a roller support shaft 9 extending parallel to the sheet feeding direction that in turn axially rotatably supports the upper roller 2 therebetween.

On the other hand, the arm support shaft 7 pivotally supports a second pivotally moving arm 10 that extends downward with a distal end thereof provided with a cam follower 12 that runs on a cam 11. The first pivotally moving arm 8 is urged by a coil spring 13 so as to allow the upper roller 2 to rotate in such a direction as to come into contact with the lower roller 3. This urging force is transmitted to the second pivotally moving arm 10 via an intermediate member 30, thereby urging the cam follower 12 in such a direction as to allow the same to come into contact with the cam 11. With this arrangement, when the sheet 1 is moved forward to the printing section, the cam 11 causes the second pivotally moving arm 10 and the first pivotally moving arm 8 to rotate in the anti-clockwise direction as viewed in FIG. 2 against the urging force of the coil spring 13 by a given angle, thereby moving the upper roller 2 upward away from the lower roller 3, thereby allowing both the rollers 2, 3 to have a gap therebetween and hence the sheet 1 to pass therethrough. Once the sheet 1 abuts the leading-edge abutment member 4, both the pivotally moving arms 8, 10 rotate by a given angle upon receiving the urging force of the coil spring 13 in the clockwise direction as viewed in FIG. 2, thereby allowing the upper roller 2 to move close to the lower roller 3 to clamp the sheet 1 therebetween, and then both the rollers 2, 3 to rotate. Thus, the sheet 1 is displaced leftward by a given distance as viewed in FIG. 2. The urging force to be applied to both the pivotally moving arms 8, 10 by the coil spring 13 is adjustable by rotating a dial 14 mounted on the top.

Figure 4:
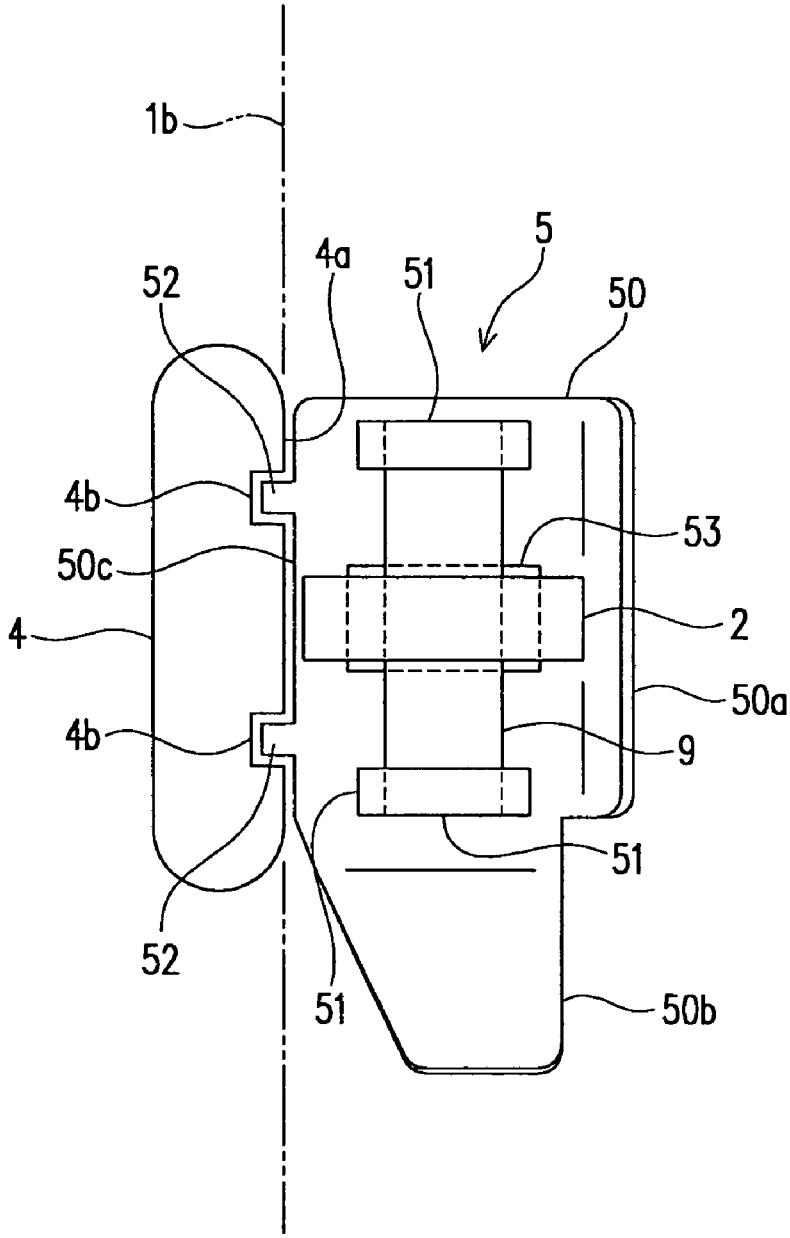
FIG. 4 is a plan view illustrating an essential portion of the sheet positioning apparatus of FIG. 1.

The lateral-edge abutment member 4 is mounted on the upper surface 6 of the feeder board. Specifically, as illustrated in FIG. 2, the lateral-edge abutment member 4 is disposed on the left side of the pair of rollers 2, 3, and is for example of a plate-like member having a predetermined thickness. An end surface 4*a* of the abutment member 4 acts as a stopper surface which the lateral edge 1*b* of the sheet 1 abuts. FIG. 4 is a plan view illustrating only an essential portion of the sheet positioning apparatus of this embodiment. As illustrated in this Figure, the end surface 4*a* acting as the stopper surface of the lateral-edge abutment member 4 has a predetermined length in the sheet feeding direction. The end surface 4*a* has recesses 4*b* corresponding in position to projections 52 of a sheet-holding-down member 5, which will be described later, so as to avoid interference with the same.

Now, the description will be made for the sheet-holding-down member 5. The sheet-holding-down member 5 is pivotally supported by the roller support shaft 9 in such a manner as to be pivotally movable rightward and leftward about the shaft 9. With this arrangement, when the first pivotally moving arm 8 has been pivotally moved upward and thereby the upper roller 2 has been moved upward away from the lower roller 3, the sheet-holding-down member 5 is also moved upward. The sheet-holding-down member 5 has a thin-plate-like guide part 50 that faces the upper surface 6 of the feeder board, and a pair of fore and aft shaft support members 51 that project from an upper surface of the plate-like guide part 50. In this embodiment, the plate-like guide part 50 and both the shaft support members 51 are made independently of each other and therefore made up of three parts in total, while it is possible to form them integral to each other as an integral part. The plate-like guide part 50 has a right end 50*a* bent upward, while the plate-like guide part 50 has a rear end 50*b* bent upward. The right end 50*a* of the plate-like guide part 50 extends slantingly upward in order to make the sheet 1 smoothly pass therethrough when the sheet is displaced towards the side close to the lateral edge 1*b*. This arrangement makes it hard to damage the sheet 1 by the right end 50*a* of the plate-like guide part 50 during the sheet 1 is laterally displaced. The rear end 50*b* of the plate-like guide part 50, which also extends slantingly upward, acts as a guide to guide the sheet 1 and hence allow the same to smoothly move forward through the pair of rollers 2, 3. The plate-like guide part 50 also has a left end 50*c* that has the aforesaid pair of laterally extending projections 52. The projections 52 laterally extend across the end surface 4*a* of the lateral-edge abutment member 4 as viewed in plan of FIG. 4, and therefore together act as a sheet-holding-down part to hold down the sheet from above so as to prevent the lateral edge 1*b* of the sheet 1 from being curled upward when the lateral edge 1*b* abuts the lateral-edge abutment member 4. It is preferable to employ plural projections placed at a given distance from each other in the sheet feeding direction in the same manner as in this embodiment. The plate-like guide part 50 is located beneath the roller support shaft 9. In this arrangement, the plate-like guide part 50 has for example a rectangular window 53 substantially at the center portion, through which the upper roller 2 can contact the sheet 1. The pair of shaft support members 51, which project from the upper surface of the plate-like guide part 50, respectively have through-holes extending parallel to the sheet feeding direction, into which the roller support shaft 9 is inserted so that the sheet-holding-down member 5 can pivotally move about the roller support shaft 9. As illustrated in FIG. 3, the pair of fore and aft shaft support members 51 are located with the pair of extensions 8*a*, 8*b* therebetween in the sheet feeding direction.

On the other hand, one of the pair of extensions 8*a*, 8*b* of the first pivotally moving arm 8 or the extension 8*b* in this embodiment has an adjustment screw 20 as a limiter that has a lower end adapted for abutting the upper surface of the plate-like guide part 50, and a coil spring 21 as an urging means for urging the plate-like guide part 50 into abutment with the lower end of the adjustment screw 20. The adjustment screw 20 is located on the right side of the roller support shaft 9 (close to the opposite lateral edge of the sheet 1) as viewed in FIG. 3, and limits movement of the plate-like guide part 50 so as to prevent the projections 52 of the plate-like guide part 50 from passing a predetermined height limit and moving closer to the upper surface 6 of the feeder board. The coil spring 21 is located on the left side of the roller support shaft 9 (close to the lateral edge 1*b* of the sheet 1) as viewed in FIG. 3, and urges the plate-like guide part 50 through its upper surface into abutment with the lower end of the adjustment screw 20. That is, the coil spring 21 urges the plate-like guide part 50 so as to allow the projections 52 to move close to the upper surface 6 of the feeder board. The height of the lower end of the adjustment screw 20 can be adjusted by the rotation of a dial 22 mounted on the upper end, thereby allowing the sheet-holding-down member 5 to pivotally move for fine adjustment of the height of the projections 52. In normal operation, the height of the projections 52 is set to be adapted for relatively thin sheets having a thickness smaller than a predetermined thickness. In this embodiment, with the height of the projections 52 adapted for such normal operation, the plate-like guide part 50 as a whole slants upward to the right. As illustrated in FIG. 1, the dial 22 is scaled on its top and has a circumferential surface having vertical grooves formed at a given distance from each other. A blade spring 23, which is fixed at its proximal end to an upper surface of the first pivotally moving arm 8 with a screw, come into engagement at its distal end with each of the vertical grooves to prevent free rotation of the adjustment screw 20. A magnitude of the urging force exerted by the coil spring 21 is not necessarily set to be large, as long as it is possible to prevent the lateral edge 1*b* of a relatively thin sheet, which has a small stiffness, from being forced upward or curled upward when the sheet 1 has abut the lateral-edge abutment member 4, while allowing the sheet-holding-down member 5 to be moved upward upon receiving pressure from the lateral edge 1*b* of a relatively thick sheet or a sheet having a thickness larger than a predetermined thickness.

The sheet 1 is thus positioned by using the sheet positioning apparatus having the above arrangement. As described above, the projections 52 are positioned as close as possible to the upper surface 6 of the feeder board in normal operation, it is possible to securely prevent upward curling of the lateral edge 1*b* of a relatively thin sheet (e.g., a sheet having a thickness smaller than a predetermined thickness such as 0.1 mm), when it has abut the lateral-edge abutment member 4. If a relatively thick sheet (e.g., a sheet having a thickness larger than a predetermined thickness such as 0.1 mm) is used, while holding the sheet-holding-down member 5 in the same state without rotating the adjustment screw 20, mainly the lateral edge 1*b* of the sheet 1 presses a lower surface of the plate-like guide part 50 upward when the sheet 1 is displaced to the side close to the lateral edge 1*b* by the pair of rollers 2, 3, which pressure causes a clockwise moment as viewed in FIG. 2 acting on the plate-like guide part 50. Upon receiving pressure from the sheet 1, the plate-like guide part 50 is pivotally moved against the urging force of the coil spring 21, thereby allowing the projections 52 to move upward away from the feeder board. Thus, the lateral edge 1*b* of the sheet 1 abuts the lateral-edge abutment member 4, achieving the lateral positioning of the sheet 1. When this sheet 1 has been fed to the printing section, the plate-like guide part 50 pivotally moves in the opposite direction and returns by the urging force of the coil spring 21 to the original position at which the plate-like guide part 50 abuts the lower end of the adjustment screw 20. Thus, a sheet having a thickness larger than a predetermined thickness can be used without causing any problem by setting the sheet-holding-down member 5 at a position suitable for a relatively thin sheet or a sheet having a thickness smaller than a predetermined thickness. As a result, it is possible to reduce the operator's workload in changing to sheets having a different thickness. Since the sheet-holding-down member 5 is designed to be pivotally movable, the projections 52 can be smoothly retracted upward as compared with an arrangement where the sheet-holding-down member 5 is linearly moved upward. Since the roller support shaft 9 also acts as a pivotal shaft of the sheet-holding-down member 5, an additional shaft exclusively used for the sheet-holding-down member 5 is not needed, which contributes to a simplified structure. As described above, as long as the sheet-holding-down member 5 is set at a position suitable for a relatively thin sheet, it may not be necessary to perform fine adjustment by the adjustment screw 20. This fine adjustment by the adjustment screw 20 however enables the apparatus to deal with greater variation in thickness, stiffness and the like of a sheet, thus achieving more accurate positioning.

Although the projections 52 are provided in pair along the sheet feeding direction in the above embodiment, various modifications to the number, position, shape and the like of the projections 52 can be made within the scope of the present invention. Although the projections 52 are integrally formed with the plate-like guide part 50 so as to act as a sheet-holding-down part in the above embodiment, the sheet-holding-down part may be formed independently of the plate-like guide part 50. For example, the plate-like guide part 50 is formed separately from the sheet-holding-down member 5 and fixed to the first pivotally moving arm 8, while only the sheet-holding-down member is connected to the shaft support members 51 so as to be pivotally movable about the roller support shaft 9. It is also possible to use an urging means other than the coil spring 21. The adjustment screw 20 provided as a limiter may be fixed in position so as to fix the height limit, and various modifications to the structure of this limiter can be made within the scope of the present invention.

This specification is by no means intended to restrict the present invention to the preferred embodiments set forth therein. Various modifications to the sheet positioning apparatus, as described herein, may be made by those skilled in the art without departing from the spirit and scope of the present invention as defined in the appended claims.

What is claimed is:

1. A sheet positioning apparatus in a sheet feeding section for lateral positioning of sheets, each placed on a feeder board and fed in a sheet feeding direction to a printing section of a printing press comprising:

a laterally displacing means of displacing an oncoming sheet laterally with respect to the sheet feeding direction;

a lateral-edge abutment member disposed on one of the opposite lateral sides of the laterally displacing means and mounted on an upper surface of the feeder board to abut a lateral edge of the sheet when said sheet has been displaced by the laterally displacing means, so as to achieve lateral positioning;

a sheet-holding-down member that holds down the sheet from above for preventing the lateral edge of the sheet from being curled upward when the sheet abuts the lateral-edge abutment member;

said sheet-holding-down member being movable close to and away from the upper surface of the feeder board;

a limiter for limiting movement of the sheet-holding-down member so as to prevent the same from moving close to the upper surface of the feeder board as passing a predetermined height limit;

an urging means disposed above the sheet-holding-down member for pivotally urging the sheet-holding-down member towards the upper surface of the feeder board; and said laterally displacing means comprising a pair of upper and lower rollers that rotate with the sheet clamped there between;

a roller support shaft that axially rotatably supports the upper roller of the pair of upper and lower rollers, and axially supports the sheet-holding-down member in such a manner as to allow the sheet-holding-down member to be pivotally movable about the roller support shaft;

said sheet-holding-down member including a thin-plate guide part that faces the upper surface of the feeder board, and shaft support members that project from an upper surface of the thin-plate guide part, wherein said thin-plate guide part has lateral ends, a first of which is proximate to said lateral-edge abutment member and a second of which extends slantingly upward, whereby said urging means urges said first lateral end towards said feeder board and said second lateral end away from said feeder board; and wherein said sheet-holding-down member is pivotally moved about the roller support shaft so as to be moved upward away from the upper surface of the feeder board against the urging force of the urging means by the thin-plate guide part upon receiving pressure from the sheet displaced by the pair of upper and lower rollers, in accordance to the sheet having a thickness larger than a predetermined thickness substantially equal to the predetermined height limit.

2. The sheet positioning apparatus according to claim 1, further comprising a height adjusting mechanism that adjusts the limiter in height so as to vary the predetermined height limit.

3. The sheet positioning apparatus according to claim 1 wherein the predetermined thickness is 0.1 mm.

4. A sheet feeder comprising:

a feeder board having an upper surface;

a lateral-edge abutment member mounted on said upper surface of said feeder board;

a pair of rollers adapted to move a sheet supported by said upper surface of said feeder board towards said lateral edge abutment member, said pair of rollers including an upper roller rotatably supported by a roller support shaft; and a sheet-holding-down member pivotally supported by said roller support shaft, said sheet-holding-down member having a thin-plate guide part having a first edge which is located proximate to said lateral-edge abutment member and a second edge which is located distal from said lateral-edge abutment member, said sheet-holding-down member including a spring urging said first edge of said thin-plate guide part towards said upper surface of said feeder board and said second edge of said thin-plate guide part away from said upper surface of said feeder board by pivoting said sheet-holding-down member on said roller support shaft.

* * * * *